United States Patent [19]

Muller

[11] 4,350,264

[45] Sep. 21, 1982

[54] VENDING MACHINE FOR FLAT SHEET ARTICLES

[76] Inventor: Alois Muller, 138 Elvaston Dr., Toronto, Ontario, Canada

[21] Appl. No.: 97,124

[22] Filed: Nov. 26, 1979

Related U.S. Application Data

[63] Continuation-in-part of Ser. No. 894,822, Apr. 10, 1978, abandoned.

[51] Int. Cl.[3] ..... G07F 11/04

[52] U.S. Cl. ..... 221/67; 221/197; 221/281; 312/60

[58] Field of Search ..... 221/67, 281, 287, 197, 221/198, 312 R; 49/255; 312/50, 60

[56] References Cited

U.S. PATENT DOCUMENTS

| | | | |
|---|---|---|---|
| 1,434,057 | 10/1922 | Horwitt | 221/67 |
| 1,663,510 | 3/1928 | Wessman | 221/287 X |
| 2,221,016 | 11/1940 | Wood | 221/281 X |
| 2,665,184 | 1/1954 | Hord | 221/197 X |
| 2,937,785 | 5/1960 | Muller | 221/67 |
| 3,158,288 | 11/1964 | Muller | 221/67 |
| 3,486,658 | 12/1969 | Cheslak et al. | 221/287 X |
| 3,710,976 | 1/1973 | Guidi et al. | 221/67 |
| 3,773,223 | 11/1973 | Guidi et al. | 221/67 |
| 4,023,704 | 5/1977 | Pitel et al. | 221/75 |
| 4,087,020 | 5/1978 | Krakauer | 221/297 X |

FOREIGN PATENT DOCUMENTS

| | | | |
|---|---|---|---|
| 542854 | 6/1957 | Canada | 49/255 |

*Primary Examiner*—F. J. Bartuska

*Attorney, Agent, or Firm*—George A. Rolston; William F. Frank

[57] ABSTRACT

A vending machine for thin flat sheet articles wherein the article release mechanism comprises two pairs of diametrically opposed swingable trap doors, the trap doors being mounted on respective door mounting blocks and wherein the door mounting blocks incorporate recesses for registering with the article magazine, and article guides automatically aligning with the lower end of the magazine and extending below the level of the doors, whereby to guide individual articles from the magazines through the trap doors to ensure a precisely regulated feeding of articles.

20 Claims, 11 Drawing Figures

VENDING MACHINE FOR FLAT SHEET ARTICLES

This application is a continuation-in-part of application Ser. No. 894,822 entitled Vending Machine for Flat Sheet Articles, filed Apr. 10th, 1978 now abandoned.

The invention relates to vending machines for vending articles of a thin rectangular shape, such as booklets of postage stamps and the like.

Vending machines for thin sheet articles are disclosed in U.S. Pat. Nos. 2,937,785 and 3,158,288. In such prior art vending machines, the articles are of rectangular shape and are thus stacked alternately across one another. The cross stacked articles are supported in vertical columns, by means of vertical magazines or storage walls. At the bottom of such magazines, two opposite pairs of trap doors are provided, interlocked by an operating mechanism. One pair of trap doors is held in a horizontal, article supporting position while the other pair of doors is operated to flap downwardly thereby permitting an article supported thereon to drop down.

This principle of operation has been found to be highly reliable and satisfactory and has given many years of trouble free service in the past.

In order to function satisfactorily however it was necessary that a good deal of care was exercised in the assembly and final adjustment of the apparatus. In particular, it was necessary that the vertical magazines or storage walls be very carefully aligned with the trap doors, and trap door supporting frames and the like. It will of course be appreciated that the articles being dispensed by such a mechanism are very light, consisting only of two or three sheets of paper, and the least obstruction will cause a misfeed and jam the mechanism. Present day manufacturing conditions make it difficult to obtain skilled labour, which can be trained for these relatively exacting and time consuming tasks. It is therefore desirable to provide a modified form of construction in which the various components are self aligning so as to reduce or practically speaking eliminate the requirement for the adjustment of the mechanism during manufacture.

In addition to these manufacturing problems, the servicing of such vending machines in the field also present certain problems. Such vending machines especially in the case of postage stamps are frequently located out of doors. Repairing or adjusting the mechanism in such locations is often inconvenient. In addition, it may be difficult to train sufficient personnel for the purposes of staffing service trucks and the like with trained mechanics capable of repairing defective machines.

Accordingly, it is desirable to provide in such machines for the entire storage magazine and dispensing mechanism to be readily removable from the machine, and replaceable by a service unit which can simply be reinstalled in its place more or less instantaneously, and the defective unit returned to a central workshop.

In addition, the refilling of the magazine with thin flat articles such as postage stamps has in the past required a certain amount of manual dexterity. In the event that the articles are not installed in the magazine in the correct flat cross stacked manner then they will not feed smoothly from the magazine. It is again desirable as far as possible that the recharging of such magazine be simplified so as again to both reduce the amount of skill and training required, and also to reduce servicing time.

In particular it is desirable that the vending machine and the article dispensing unit or units shall be completely independent and separable, except for the connection of an electrical cord. In this way the housing can carry the push button controls, and control circuits, and coin rejection mechanism, and the dispensing units can comprise a complete unit having a base, a hopper, a dispensing mechanism and a motor for operating the mechanism. The cord may of course be either on the dispensing unit, or the housing, or both.

With a view to overcoming these various disadvantages, the invention seeks to provide a vending machine for thin flat sheet articles wherein the article release mechanism comprises two pairs of diametrically opposed swingable trap doors, the trap doors being mounted on respective door mounting blocks and wherein the door mounting blocks incorporate recesses for registering with the article magazine, and article guides automatically aligning with the lower end of the magazine and extending below the level of the doors, whereby to guide individual articles from the magazines through the trap doors to ensure a precisely regulated feeding of articles.

The invention further provides a vending machine for thin flat sheet articles, such vending machine having a housing, an article dispensing unit having a hopper, a base plate, dispensing machanism, power operated means, and the housing having support means and slide means for receiving the dispensing unit and remotely operable control means on the housing for controlling the power operated means.

The invention further seeks to provide a vending machine having the foregoing advantages and further having article support rails within the vending machine housing, for slidably supporting said base plate thereon, and releasable locking means interengagable between said base plate and at least one of said rails, whereby a said dispensing unit may be locked in position thereon, and may be readily released therefrom for replacement.

The invention further seeks to provide a vending machine for thin flat sheet articles, wherein the articles are stored in a vertical stack, in a magazine, and wherein the magazine incorporates one or more releasable wall members, whereby the magazine may be opened up along its vertical length, thereby giving access to the interior to facilitate stacking of articles therein, the wall being replaceable to complete the magazine around the articles after the same has been recharged.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 1:
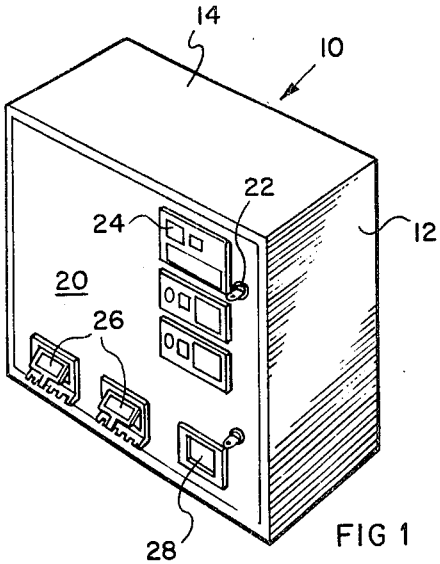
FIG. 1 is a perspective frontal illustration showing the vending machine according to the invention.
Figure 2:
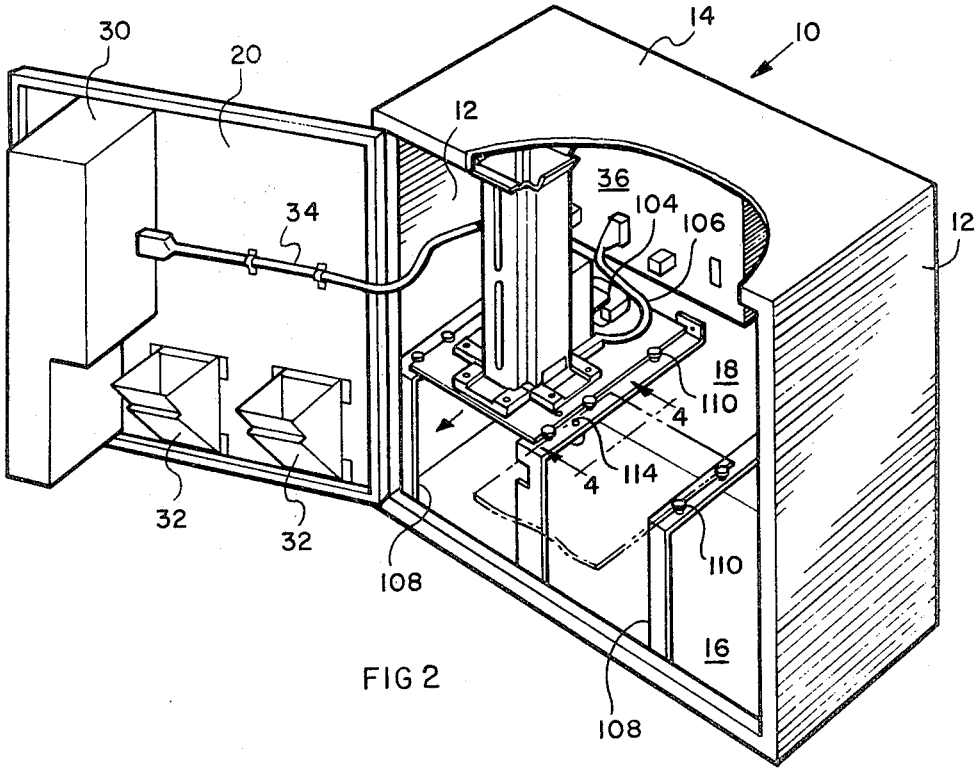
FIG. 2 is a similar view showing it opened up.

Referring now to FIGS. 1 and 2 it will be seen that the vending machine according to the invention comprises a generally rectangular box-like housing 10 having side walls 12, top walls 14, bottom wall 16 and rear wall 18.

The front door panel 20 is hinged to one of the side walls 12, and may be locked shut by means of a lock and key 22.

On the front face on the door panel 20 there is provided a coin slot 24, an article dispending openings 25 and door 26, and a coin return door and opening 28.

On the inner face of the door panel 20, there is provided a coin rejector mechanism shown generally as 30, and two article delivery chute means 32.

The coin rejector mechanism 30 is not described in detail, and is of a type well known in the vending art. It is electrically operated and is connected by means of a cable 34 to a control box 36 mounted on rear wall 18 of housing 10.

Control box 36 is of course provided with any suitable cable (not shown) whereby it may be plugged into a source of electrical power.

Within the housing 10 there are located, in this embodiment of the invention two article dispensing units, one of which is indicated generally as 40, the other article dispensing mechanism being omitted for the sake of clarity. It will however be appreciated that such a further unit 40 would normally be incorporated.

The invention is not however restricted to a vending machine having two such article dispensing units 40. There could be a single such unit or there could be multiples of such units depending on the particular application.

The article dispensing unit 40 is shown in more detail in FIGS. 4 to 9. The dispensing unit 40 performs two functions namely that of storing a sufficient quantity of articles, and also of dispensing or releasing the articles one by one as they are purchased.

In order to store the articles, generally channel shaped vertical wall members 42 are arranged to form an upstanding hopper or magazine-like structure. The four channel walls are referenced 42*a, b, c* and *d* respectively. Each of the channel walls 42*a, b* & *c* are of similar construction and are securely fastened together for example by welding or the like (not shown) so that they form a rigid vertical structure. The upper ends may be flaired outwardly to facilitate insertion of articles therein.

At their lower ends they are provided with generally L shaped mounting brackets 44. The fourth channel wall 42*d* may be similar to walls 42*a, b* and 6, or may be hingedly mounted to wall 42*a* so that it may be swung to and fro, to give access to the interior of the hopper or magazine thereby facilitating insertion of articles therein.

Figure 5:
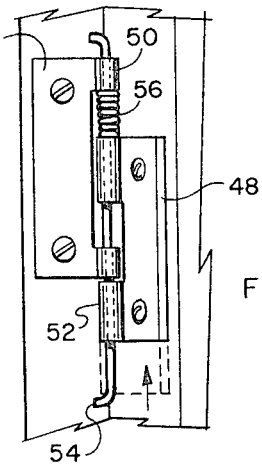
FIG. 5 is a greatly enlarged perspective showing the hinge mechanism.

The hinge means which is shown in more detail in FIG. 5 comprises left and right hand hinge flanges 46 and 48, having respective tubular sleeve portions 50 and 52 for reception of a hinge pin 54 therethrough. The sleeve portion 50 and 52 are spaced apart a greater distance than in conventional hinges, so that the flange portion 48 may be moved vertically upwardly and downwardly with reference to the hinge flange 46, along the hinge pin 54.

Coil springs 56 are located on hinge pins 54 between sleeves 50 and 52.

Figure 6:
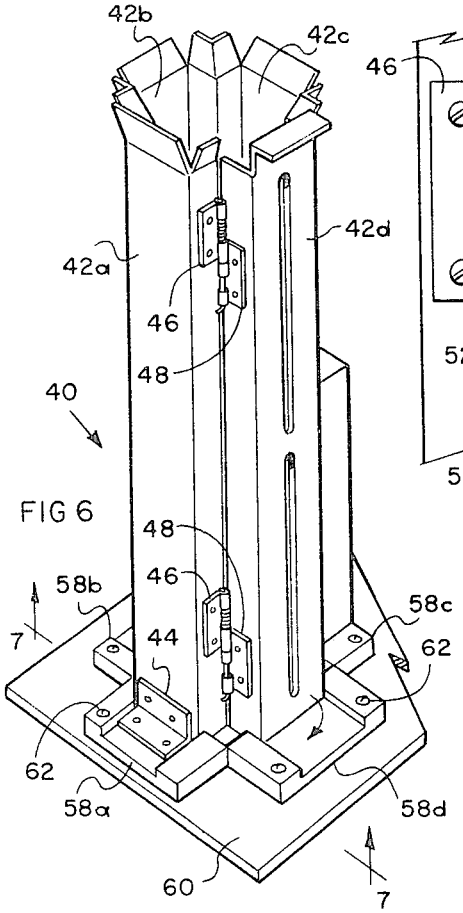
FIG. 6 is a perspective illustration showing the article dispensing unit and magazine.

It will be noted in FIG. 6, that the wall 42*d* is not provided with a bracket at 44 its lower end, so that it is in fact free to be slid upwardly and downwardly on the two hinge pins 54 against springs 56 and to be swung away from wall 42*a* giving access to the interior of the magazine.

At the lower ends of the channel walls 42*a, b, c* and *d*, there are provided four mounting block members 58*a, b, c* and *d*. The mounting blocks 58 are all fastened to a base plate 60 by means such as bolts 62.

A central opening indicated as 64 (see FIG. 8) is provided through base plate 60, registering with the four walls 42.

Figure 8:
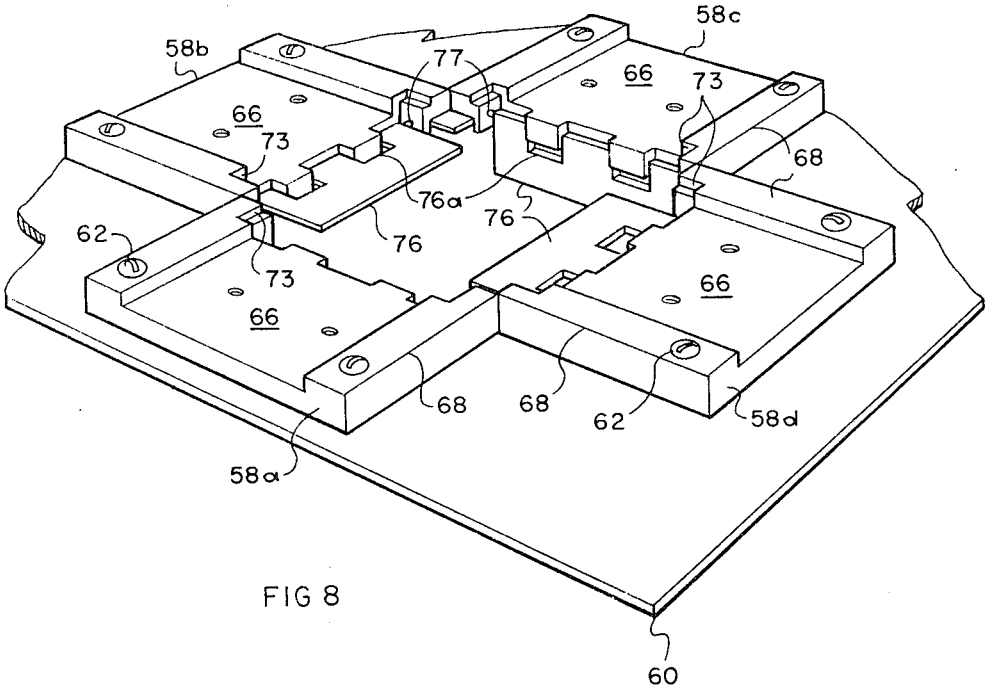
FIG. 8 is a perspective illustration of a portion of the trap doors and guide means.
Figure 9:
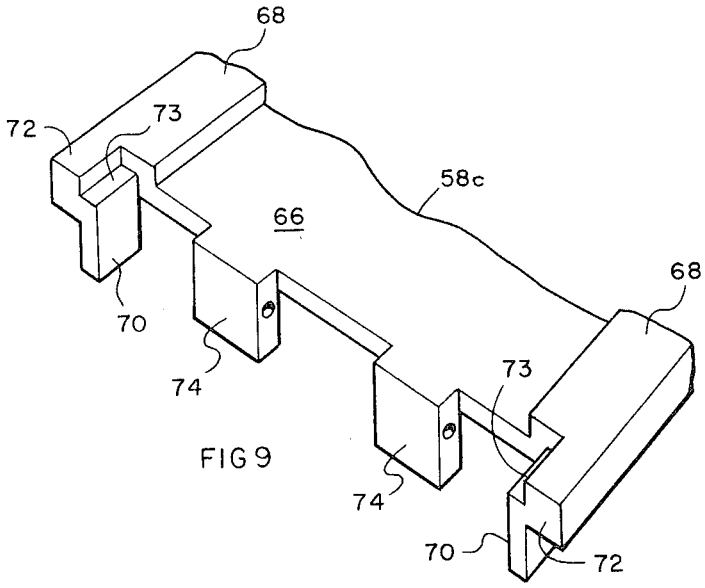
FIG. 9 is an enlarged perspective of one of the guide means.

As best shown in FIGS. 8 and 9 each of the mounting blocks 58 comprises a generally planar centre portion 66, and two side rib portions 68, each of which extend forwardly of the centre portion 66, and are provided with downwardly dependent guide plates 70 and forwardly extending fingers 72.

Further downwardly dependent guide plates 74 are provided on the leading edge of the centre portion 66.

Each of the mounting blocks 58 is mounted on a respective side of opening 64 in base plate 60, and guide plates 70 and 74 extend through such opening, so as to guide the passage of an article therethrough.

In each of fingers 72 there is formed a locating recess 73. Each recess 73 receives one corner of a channel wall 42 and precisely locates it to ensure clean feeding.

Beneath each of the mounting blocks there is provided a trap door flap 76, hingedly mounted in hinge pin 77 secured below block 58 on an axis located rearwardly of the front face of guide plates 74 so as to swing between a vertically downwardly dependent position and a horizontal position as shown in FIG. 8.

Trap door flaps 76 are generally rectangular having two larger sides and two shorter sides.

Each of the trap doors have rectangular recesses 76*a* registering with guides 74. Recesses 76*a* are both located along the same longer side, and on the same side as the hinge pin 77. In this way the trap doors can swing downwardly around guides 74 and clear of them, and will hang in a plane offset outwardly from guides 74 so as to avoid interfering with the article dropping therethrough.

The trap door flaps 76 are operated in opposite pairs, so that when one opposite pair is swung upwardly, the other opposite pair is swung downwardly.

Figure 7:
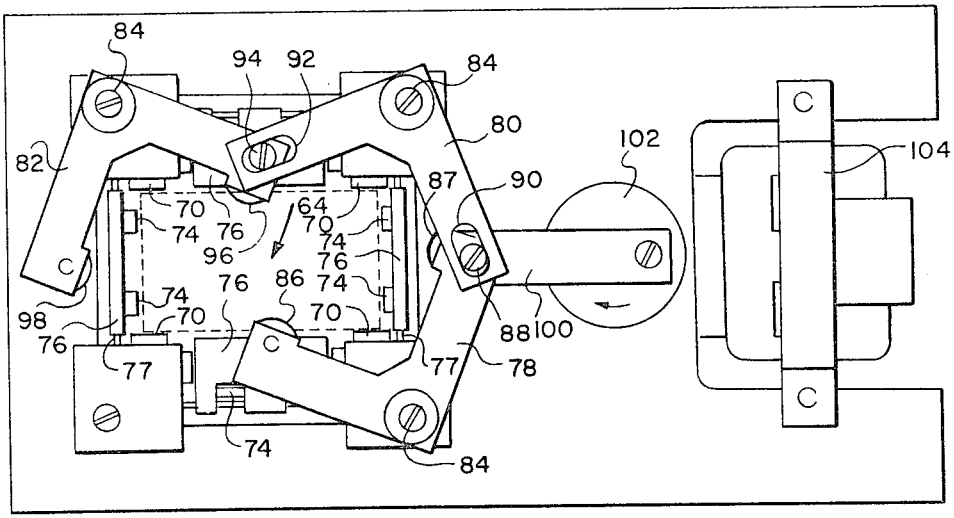
FIG. 7 is a lower plan view looking upwardly beneath FIG. 6, showing the details of the article release mechanism.

The mechanism by which this is achieved is shown in FIG. 7. Such operating mechanism is essentially similar in concept to that already disclosed in U.S. Pat. Nos. 2,937,785 and 3,158,288, with certain differences. It will be seen to comprise three bell cranks 78, 80 and 82, each of which is pivotally mounted on a bolt 84, on the underside of the base plate 60.

Bell crank 78 is provided with a boss 86 at one end, and boss 87 and a crank pin 88 at the other end. Bell crank 80 is provided with a slotted opening 90 receiving crank pin 88 at one end and a slotted opening at 92 at the other end.

Bell crank 82 is provided with a crank pin 94 at one end running in slotted opening 92 and is further provided with a boss 96 at the same end as crank pin 94 and a further boss 98 at the other end.

It will thus be seen that all of bell cranks 78, 80 and 82 are linked together by crank pins 88 and 94 for swinging movement in unison.

Swinging movement is procured through, for example, bar 100, driven from hub 102, which is in turn driven by any suitable electrical motor and drive train shown generally as 104.

Motor 104 is connected by any suitable means such as cable 106 to control box 36.

Bosses 86, 87, 96 and 98 engage the undersurfaces of respective door flaps 76, and procure swinging movement thereof upon operation of motor 104.

Figure 11:
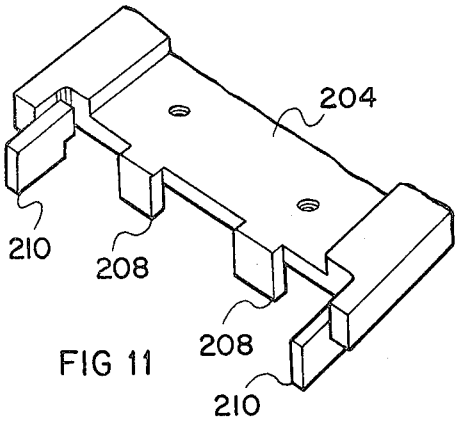
Figure 10:
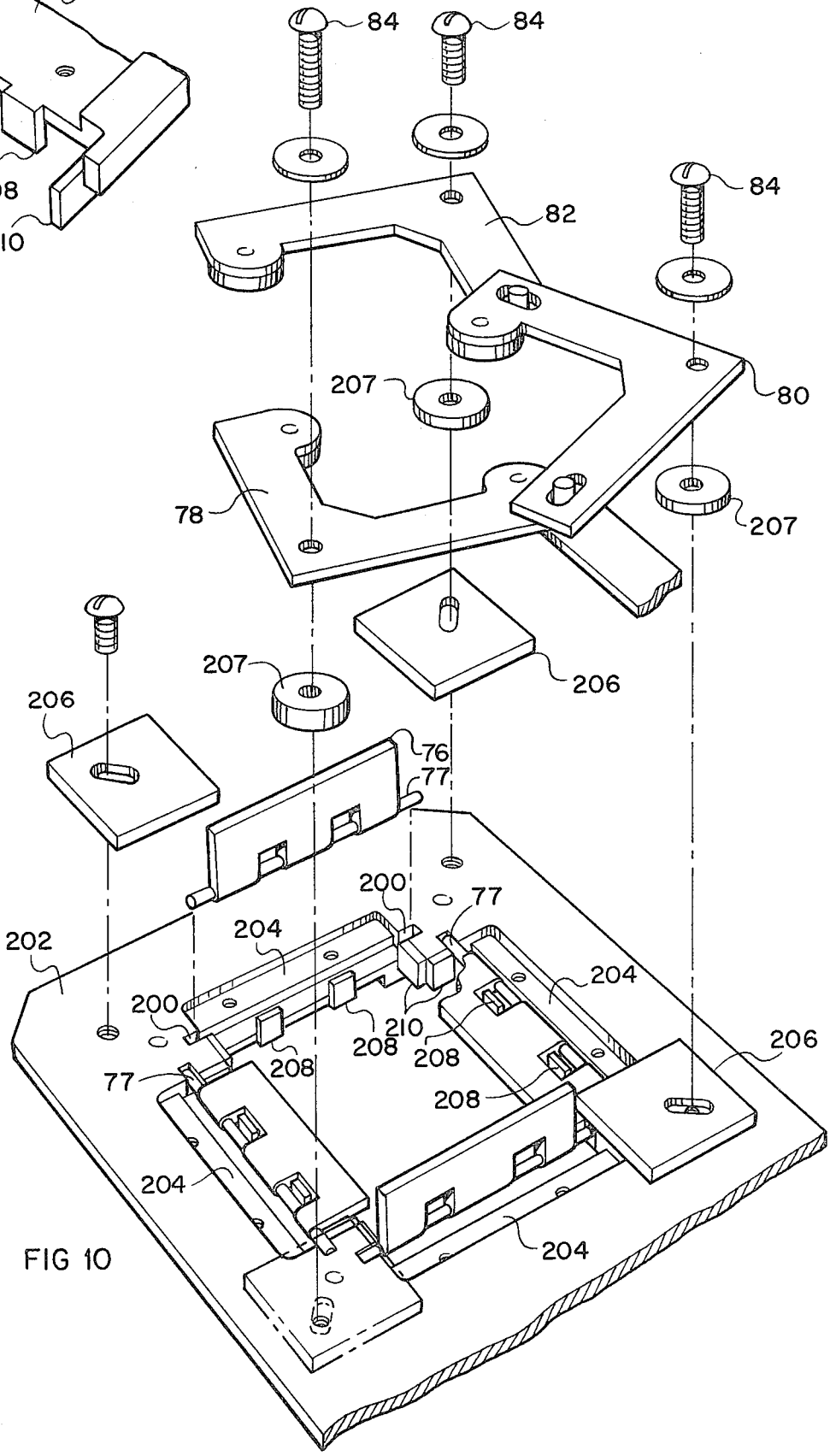
FIG. 10 is a partially exploded lower perspective view of the operating linkage and trap door flaps; and, FIG. 11 is a perspective of the mounting brackets of FIG. 10.

As best shown in FIGS. 10 and 11, the hinge pins 77 extend through suitable openings in the longer sides of trap door flaps 76, and are received in slots 200 formed in base plate 202 on either side of modified mounting blocks 204. Pins 77 are held in such slots by being sandwiched between the undersurfaces of blocks 204, and corner plates 206, on the underside of base plate 202.

Spacer discs 207 of different thickness separate bell cranks 78, 80 and 82 by different distances from corner plates 206 and are all held in position by bolts 84.

Mounting blocks 204 in FIGS. 10 and 11 have guide members 208 generally similar to guides 74, but guides 210 are somewhat larger and extended as compared with guides 70, and are cut away to permit entry of hinge pins 77 into slots 200 in base plate 202.

Bell cranks 78, 80 and 82 are unchanged, as is the bar 100, and crank 102 and motor 104.

In order to support each of the article dispensing units 40 inside housing 10, there are provided generally right angular frame members 108, three being shown in this embodiment of the invention for supporting the two article dispensing units 40. It will be appreciated that if more article dispensing units were employed there would be additional such frame members employed. The frame members 108 are provided on their horizontal portions with retaining pins 110 having heads 112, located at spaced intervals therealong. The heads 112 are such that they fit snugly over the edges of the base plate 60. In this way the base plate 60 may be slid relative to the frames 108, and is retained in position against tipping over by the heads 112.

Figure 4:
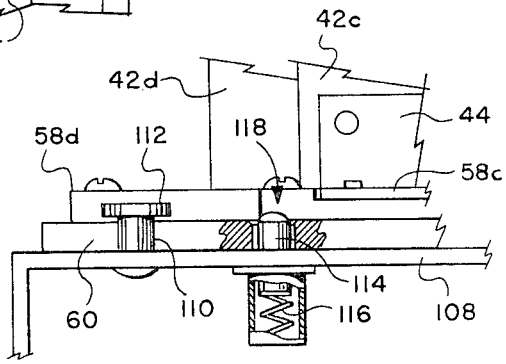
FIG. 4 is a side elevation, partly in section along the line 4—4 of FIG. 2.

In order to ensure that the article dispensing units 40 are located accurately with regard to the dispensing chutes 32, locating pins 114 are provided being operated by springs 116, and seating in suitable openings 118 in base plates 60 (FIG. 4).

Depression of pin 114 will of course permit base plate 60 and the entire unit 40 to be slid out for servicing. It will be noted that the arrangement of the retaining pins 110 is such that even when the unit 40 is slid half way out, it will still be effectively supported in a cantilever manner so that for example the filling of the magazine with articles is made much simpler since the articles may be dropped into the top of the magazine without interference from the top of the housing 10.

Removal of a unit 40 simply involves pulling the base plate 60 all the way out from the retaining pins 110, and unplugging the cable 106 from the control box 36.

The sliding support of the dispensing unit could be achieved in other ways. Thus the brackets could be modified, and the pins 110 could be placed on the base plate. The pins 110 could clearly be replaced by other forms of slidable support, and other forms of locating means could replace the pins 114.

Figure 3:
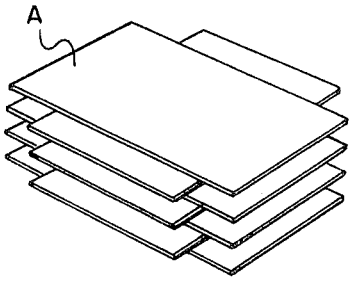
FIG. 3 is a perspective of a stack of articles.

In operation, the magazine contains articles typically thin flat rectangular booklets of postage stamps, cross-stacked as shown in FIG. 3, with the lower most article resting on one pair of opposed trap door flaps 76 in their upper position with the other pair of opposed trap door flaps 76 being swung in their downwardly dependent position.

A purchaser then inserts a suitable quantity of coins in the slot 24. The passage of the coins through the coin rejector 30 will then produce an electrical impulse which passes along cable 34 to control box 36. By suitable relays (not shown) such as are well known in the art, electrical power is passed from control box 36 along cable 106 to operate motor 104 through a predetermined operating cycle. Such movement will drive hub 102 and link 100 causing bell cranks 78, 80 and 82 to swing from one position to the other.

Such swinging movement will cause one pair of opposite trap door flaps 76 to swing upwardly and the other pair to swing downwardly. The pair that swings downwardly will release the article resting thereon.

The next article up in the stack being arranged transversely will then be caught by the other two trap door flaps which are swinging upwardly so that one article only will be dispensed downwardly through the opening 64. As it passes through the opening it will be precisely guided by contact with the guides 70 and 74 so that it falls cleanly into one of dispensing chutes 32. The purchaser can then remove the article from one of openings 26 on the front of housing 10.

When it is necessary to refill the magazine, all that is required is for the operator to open the door 20 of the housing 10, and partially withdraw the unit 40, by depressing pin 114 and sliding base plate 60 halfway out.

He then simply raises channel wall **42*d* against springs 56, so that channel wall 42*d* is no longer trapped between the ribs 68 of the mounting block 58, and channel wall 42*d*** is then free to be swung to one side.

He can then readily refill the remaining channel walls **42*a, b,* and *c* with cross-stacked articles, and then simply swing the channel wall 42*d*** back into position again.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An article dispensing unit for use in a vending machine of the type wherein articles are stacked vertically one above one another, and are dispensed downwardly one at a time, said dispensing unit comprising;

base plate means;

an opening therethrough;

mounting block means fastened on said base plate means, around said opening in fixed relation thereto;

at least three guide plate means on each of said mounting block means, at least one of said guide plate means being mounted on an edge of said mounting block means, in one plane, and two other said guide plate means being mounted on extensions of said mounting block means, in parallel spaced apart planes, at right angles to said first mentioned guide plate means, said guide plate means forming part of said mounting block means, and extending downwardly therefrom in fixed relation thereto through said opening in said base plate means, said guide plate means cooperating with one another to guide articles falling through said opening;

article storage means mounted on said mounting block means and extending upwardly therefrom in registration with said opening, and, article dispensing means movably connected to said base plate means, and being movable relative thereto for dispensing articles from said storage means.

2. An article dispensing unit as claimed in claim 1 wherein there are four mounting blocks, each of said mounting blocks having a plurality of guide plate means thereon, arranged in two planes at right angles to one another.

3. An article dispensing unit as claimed in claim 2 wherein each said mounting block comprises a central portion, and parallel spaced apart rib portions on either side thereof.

4. An article dispensing unit as claimed in claim 3 including forward extensions of said rib members on either side of said central portion, and recess means formed in said forward extensions.

5. An article dispensing unit as claimed in claim 1 wherein said article dispensing means includes article release means movable into and out of article supporting position in said opening, and operating means for operating the same whereby to dispense a single article, while retaining the remainder.

6. An article dispensing unit as claimed in claim 5 wherein said article release means includes four trap door flap members, swingably supported on said mounting block means on four sides of said opening, and swingable between horizontally extended article supporting positions, and vertically dependent article release positions.

7. An article dispensing unit as claimed in claim 6 wherein there are four mounting blocks, on four sides of said opening, and including guide plate means on said mounting blocks extending therethrough, and wherein said flap members are mounted on respective said mounting blocks, for swinging movement relative thereto as aforesaid, and including recess means in said flap members, whereby the same may swing around at least some of said guide plate means.

8. An article dispensing unit as claimed in claim 1 wherein said article storage means comprises three fixed wall members extending upwardly, and mounted on said mounting block means, and a fourth movable wall hingedly mounted on one of said fixed walls, and swingable towards and away therefrom.

9. An article dispensing unit as claimed in claim 8 including slidable hinge means connected between said movable wall and said one of said fixed walls, whereby said movable wall may be slid vertically relative to said fixed walls, and including spring means urging said movable wall downwardly, and being compressable to permit upward sliding of said movable wall against said spring means.

10. An article dispensing unit as claimed in claim 9 including recess means on said mounting block means, said walls having lower corners registering with said recess means, and said swinging wall being slidably movable into and out of said recess means to permit swinging relative to said fixed wall.

11. An article vending machine having a housing, and a door movably mounted relative thereto for access to the interior of said housing, and a plurality of removeable article storage and dispensing units adapted to store articles therein, and dispense the same as they are purchased, and comprising;

a plurality of support members mounted in a common plane extending from front to back of said housing in parallel spaced apart relation defining open spaces therebetween;

a plurality of base plate members slideably supported on said support members and spanning the spacing between adjacent said support members;

article hoppers mounted on respective base plate members and extending vertically upwardly, and for each said storage and dispensing unit, for receiving vertically stacked articles therein, said articles being downwardly movable in said hopper;

parallel side edges on opposite sides of said base plates;

article dispensing mechanism for each said storage and dispensing unit, attached thereto beneath said base plate, and movable into and out of registration with the lower end of said hopper, whereby to dispense articles therefrom, and permit the same to drop downwardly as the same are dispensed;

power operated means on said base plate operatively connected with said dispensing mechanism, for operating the same;

remotely operable control means for operating said power operated means, whereby to dispense an article from said storage and dispensing unit said control means being releasably connectible with said power operated means on said base plate;

slide means on said support members mounted in a common horizontal plane in parallel spaced apart relation and defining a predetermined spacing for reception of said side edges of a respective said base plate therein whereby the same may be slid into and out of engagement with said slide means for securing said storage and dispensing unit and permitting same to be removed from said housing for servicing, and locating means on one of said support members and said dispensing unit for locating the same in a predetermined operating position in said housing.

12. An article vending machine as claimed in claim 11 including article dispensing chutes on said door, and wherein said support members define a predetermined spacing therebeneath, for reception of said chutes beneath respective said article dispensing units.

13. An article vending machine as claimed in claim 12 wherein said article dispensing units include electrical operating mechanism, and electrical cables extending therefrom, and including electrical control panel means in said housing, and releasable plug means on the said cable, whereby each of said article dispensing units may be connected and disconnected selectively therefrom without disturbing the remainder.

14. An article vending machine as claimed in claim 12 wherein said support members comprise at least three elongated rectangular bracket members, each of said bracket members being arranged with a horizontal portion at a predetermined elevation in the housing, and a vertical portion extending downwardly therefrom at the front of said housing, said bracket members being spaced apart from one another whereby to define a clear space between both the vertical portion and the horizontal portion, whereby to permit free sliding of respective said dispensing units into and out of position without obstruction.

15. An article dispensing unit for use in a vending machine of the type wherein articles are stacked vertically above one another and are dispensed downwardly one at a time, said dispensing unit comprising;

base plate means defining an opening;

guide means on said base plate means, having upper and lower ends and extending downwardly through said base plate means within said opening and located in four planes defining four sides of a rectangle, said rectangle defining a predetermined spacing between guide means on opposed sides thereof, for guiding said articles on opposite sides as the same pass through said base plate means;

an upstanding article hopper on said base plate means above said opening;

four trap door flap members mounted beneath said base plate means, around the four sides of said rectangle, and being swingable between horizontally extended article supporting positions wherein they extend past said guide means into said rectangle, and are located in planes spaced above said lower ends of said guide means and downwardly dependent article release positions wherein they are located in planes spaced outwardly from said guide means whereby to maintain said flap members out of contact with a said article as the same passes through said opening, and, linkage means operatively extending between opposed pairs of said flap members, and operating means therefor, whereby said trap door flap members may be swung, as aforesaid, in opposed pairs.

16. An article dispensing unit as claimed in claim 15 wherein said flap members incorporate recess means, said guide means extending downwardly into said recess means, whereby said flap members may swing relative to said guide means and when in said downwardly dependent position, hang clear of said guide means.

17. An article dispensing unit as claimed in claim 15 wherein each of said trap door flap members comprises a rectangular plate-like member, having two longer sides and two shorter sides, and including at least one rectangular recess in one of said longer sides, for receiving said guide means therein, and hinge pin means extending along said longer side adjacent said at least one rectangular recess, said hinge pin means being mounted and located whereby to permit swinging of said trap door flap members between a horizontal article supporting position and a vertically dependent article release position, and in said article release position, said flap members hanging clear of said guide means, whereby to permit unobstructed downward movement of an article released by said trap door flap members.

18. In an article dispensing unit of the type having opposed pairs of trap door flap members swingable between supporting and releasing positions, and base means defining an opening therethrough, the combination therewith of trap door means comprising, article guide means on said base means and extending downwardly through said opening for guiding articles therethrough;

four trap door flap members, each said flap member being mounted on respective said article guide means beneath said base means, and being swingable between horizontal and vertical positions for dispensing of articles;

at least three lever means, each of said lever means comprising a generally L-shaped member having two arms meeting together at an angle and having two ends remote from said angle;

fastening means pivotally mounting each said L-shaped member at said angle, said fastening means being attached to said base means whereby said L-shaped members are swingable about respective said fastening means, said ends moving along arcuate movement paths;

connecting means interconnecting adjacent said arms of said L-shaped members, for swinging in unison along said arcuate movement paths, said connecting means being slideable relative to at least one of said adjacent arms to permit such arcuate movement;

trap door engaging means mounted on the ends of four of such arms and being movable therewith along such arcuate movement paths, for engaging respective said trap door flap members;

a single connecting rod member operatively coupled to two said lever means at said connecting means between two adjacent arms thereof, and, motor means connected to such rod member for operating all said lever means in unison.

19. In an article dispensing unit as claimed in claim 18, the combination therewith of spacer means between each of said lever means and said base plate, locating said lever means at different distances from said base plate.

20. In an article dispensing unit as claimed in claim 18, the combination therewith of end portions on some of said arms of said lever means, arranged in overlapping relation, slotted opening means in one of each of said overlapping ends, and, connecting pin means in the other of said overlapping ends, of each said pair, extending to a respective said slotted opening means.

* * * * *